US008007413B1

(12) United States Patent
Wu

(10) Patent No.: US 8,007,413 B1
(45) Date of Patent: Aug. 30, 2011

(54) EXERCISER WITH LENGTH-ADJUSTABLE INELASTIC STRAPS

(76) Inventor: Ying-Ching Wu, Shin-Chi Village (TW)

( * ) Notice: Subject to any disclaimer, the term of this patent is extended or adjusted under 35 U.S.C. 154(b) by 0 days.

(21) Appl. No.: 12/986,224

(22) Filed: Jan. 7, 2011

(51) Int. Cl.
*A63B 21/002* (2006.01)
*A63B 21/068* (2006.01)
*A63B 21/00* (2006.01)

(52) U.S. Cl. ..... 482/91; 482/95; 482/131; 482/904

(58) Field of Classification Search ..... 482/40, 482/43, 91, 95, 96, 126, 129, 131, 139, 143, 482/904
See application file for complete search history.

(56) References Cited

U.S. PATENT DOCUMENTS

| | | | | |
|---|---|---|---|---|
| 680,556 | A * | 8/1901 | Wieland | 482/129 |
| 1,965,511 | A * | 7/1934 | Preston | 482/129 |
| 3,752,474 | A * | 8/1973 | Macabet et al. | 482/131 |
| 4,060,240 | A * | 11/1977 | Dunston | 482/131 |
| 6,113,564 | A * | 9/2000 | McGuire | 602/32 |
| 6,322,483 | B1 * | 11/2001 | Rotella | 482/129 |
| 6,726,606 | B2 * | 4/2004 | Jacobsen | 482/121 |
| 7,044,896 | B2 * | 5/2006 | Hetrick | 482/95 |
| 7,090,622 | B2 | 8/2006 | Hetrick | 482/92 |
| 7,255,666 | B2 * | 8/2007 | Cardenas | 482/143 |
| 7,438,674 | B2 * | 10/2008 | Sjodin | 482/91 |
| 7,806,814 | B2 * | 10/2010 | Hetrick | 482/139 |
| 2003/0158024 | A1 * | 8/2003 | Saure | 482/126 |
| 2007/0173383 | A1 * | 7/2007 | Feigenbaum et al. | 482/91 |

* cited by examiner

*Primary Examiner* — Allana Lewin
(74) *Attorney, Agent, or Firm* — Alan Kamrath; Kamrath & Associates PA

(57) ABSTRACT

An exerciser includes two straps and a handle mounted to an end each strap. A connecting member is mounted to the other end of each strap. The exerciser further includes a suspension member having an inelastic strap. A stop is engaged with an end of the inelastic strap. A retaining ring is engaged with the other end of the inelastic strap. A plurality of rings is fixed to the inelastic strap. The retaining member is releasably engageable with one of the rings, so that the inelastic strap forms a loop. The connecting member is releasably engaged with one of the rings. The inelastic strap is mounted around a rod or the like or extended through a gap between a door and a door frame, allowing user to perform exercises resisting the weight of the user.

2 Claims, 9 Drawing Sheets

EXERCISER WITH LENGTH-ADJUSTABLE INELASTIC STRAPS

BACKGROUND OF THE INVENTION

The present invention relates to an exerciser and, more particularly, to an exerciser including two length-adjustable inelastic straps and two handles allowing the exerciser to exercise the muscles by performing exercises resisting the weight of the user.

A wide variety of exercisers is available on the market for exercising the muscles by resisting the weight. An example of the exercisers of this type is dumbbells. Various exercisers are required for exercising muscles of different parts of the human body. These exercisers are generally expensive and occupy a large space. Some of the exercisers allowing the user to resist the weight of a portion of the components of the exercisers have certain weights and volumes and are, thus, not suitable for use in homes. General users can only use small-size exercisers such as dumbbells.

Thus, a need exists for an exerciser that can be used at home.

BRIEF SUMMARY OF THE INVENTION

The present invention solves this need and other problems in the field of exercisers providing convenient use by providing, in a preferred form, an exerciser including a connecting member having first and second portions. A linking member includes a first linking portion and two second linking portions. The first linking portion is engaged with the second portion of the connecting member. Two connecting rings are engaged with the second linking portions. The exerciser further includes two straps each having first and second ends. Each strap includes first, second, and third sections between the first and second ends. The second section is located intermediate the first and third sections. The first end is located on an end portion of the first section, and the second end is located on an end portion of the third section. The first and second sections of each strap are hung on one of the connecting rings with the first section facing a side of the second section. The third section is folded onto the other side of the second section. The first end of each strap has a spacing to the connecting rings larger than the second end the strap. A sleeve is wound around the second and third sections of each strap. Each sleeve is fixed to the third section of one of the straps. Each sleeve is movable along the second section of one of the straps to move the third section of the strap. The exerciser further includes two first elements each having a toothed portion, an edge spaced from the toothed portion, and a transverse rod between the toothed portion and the edge. The first end of each strap is connected to the transverse rod of one of the first elements. The second and third sections of each strap are wound around the toothed portion of one of the first elements. Two second elements are respectively and pivotably connected to the first elements. Each second element includes an outer side. Each second element is pivotable between a stop position adjacent the toothed portion and a disengagement position distant to the toothed portion. The exerciser further includes two connecting straps each having two ends. The ends of each connecting strap are connected to the edge of one of the first elements and the outer side of one of the second elements. A handle is mounted to each connecting strap. A suspension belt is mounted to each handle. The exerciser further includes an inelastic strap having first and second ends. A stop is engaged with the first end of the inelastic strap and has cross sections larger than the inelastic strap. A plurality of rings is fixed to the inelastic strap. A retaining ring is engaged with the second end of the inelastic strap.

When either of the second elements is in the disengagement position, a first spacing between the third section of one of the straps engaged with the second element and one of the connecting rings is adjustable by moving one of the sleeves mounted on the strap. A second spacing between one of the handles associated with the second element to one of the connecting rings increases when the first spacing decreases.

When the handles or the suspension belts are pulled, the second elements pivot to the stop position, so that each strap is sandwiched and frictionally retained between the toothed portion of one of the first element and the outer side of one of the second elements.

The first portion of the connecting member is releasably engageable with one of the plurality of rings.

The retaining member is releasably engageable with one of the plurality of rings, so that the inelastic strap forms a loop.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figures 1, 1A:
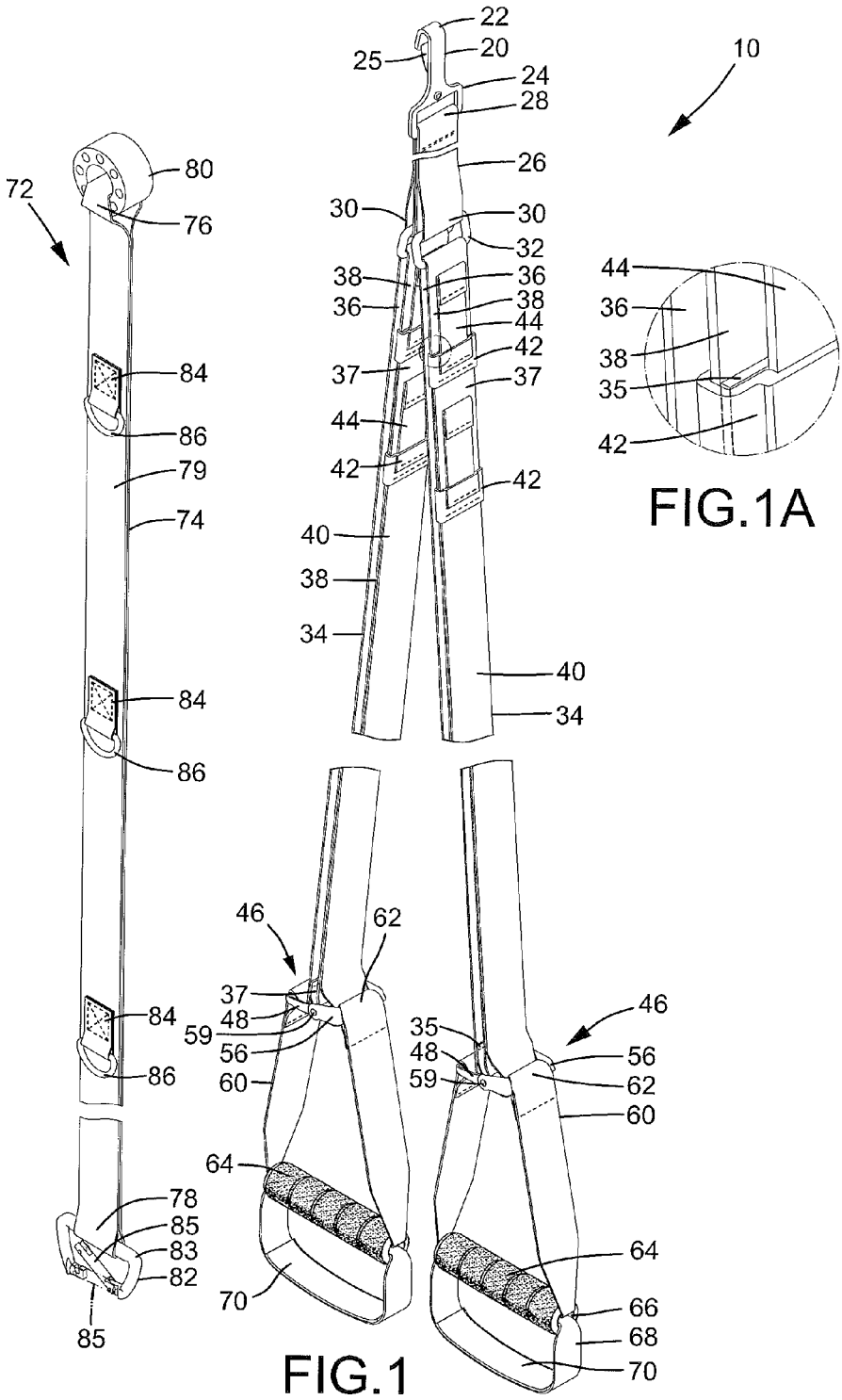
FIG. 1 shows a perspective view of an exerciser according to the present invention.
FIG. 1A shows an enlarged view of a circled portion in FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "upper", "outer", "side", "end", "portion", "section", "spacing", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

An exerciser according to the present invention is shown in the drawings and generally designated 10. According to the preferred form shown, exerciser 10 includes a connecting member 20 having a hooked, first portion 22 and a looped, second portion 24. Connecting member 20 further includes a resilient plate 25 to releasably close an opening of first portion 22.

Figure 2:
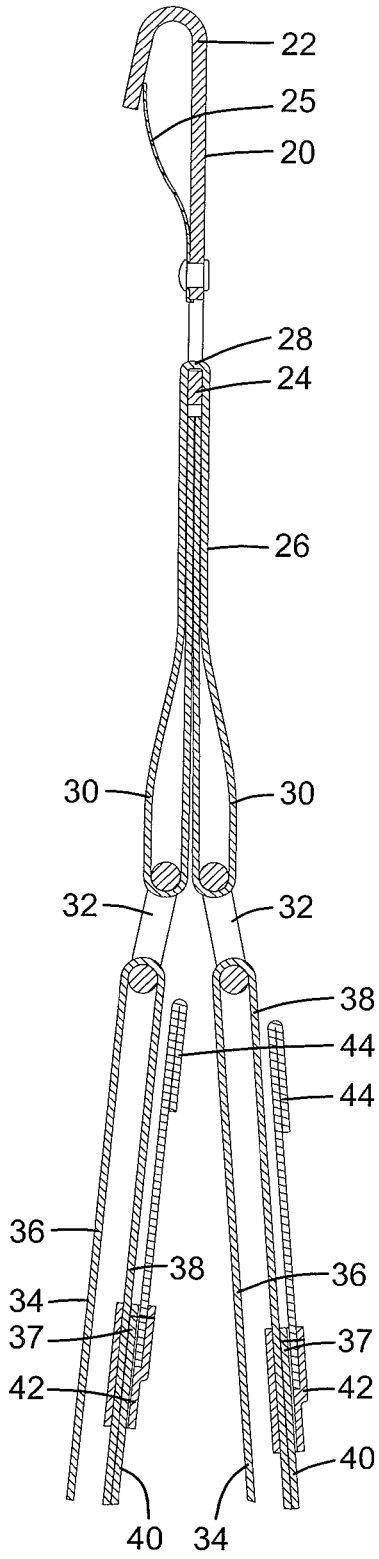
FIG. 2 shows a cross sectional view of a connecting member and portions of two length-adjustable inelastic straps of the exerciser of FIG. 1.

According to the preferred form shown, exerciser 10 further includes a linking member 26 made of inelastic fabric of canvas or nylon. Linking member 26 includes a first linking portion 28 and two second linking portions 30. First linking portion 28 is engaged with second portion 24 of connecting member 20. In the most preferred form shown, linking member 26 is a strap wound around second portion 24 of connecting member 20, and two distal ends of the strap are turned upward and sewn together to form second linking portions 30 each in the form of a loop (FIG. 2). A connecting ring 32 is engaged with each second linking portion 30.

Figure 3:
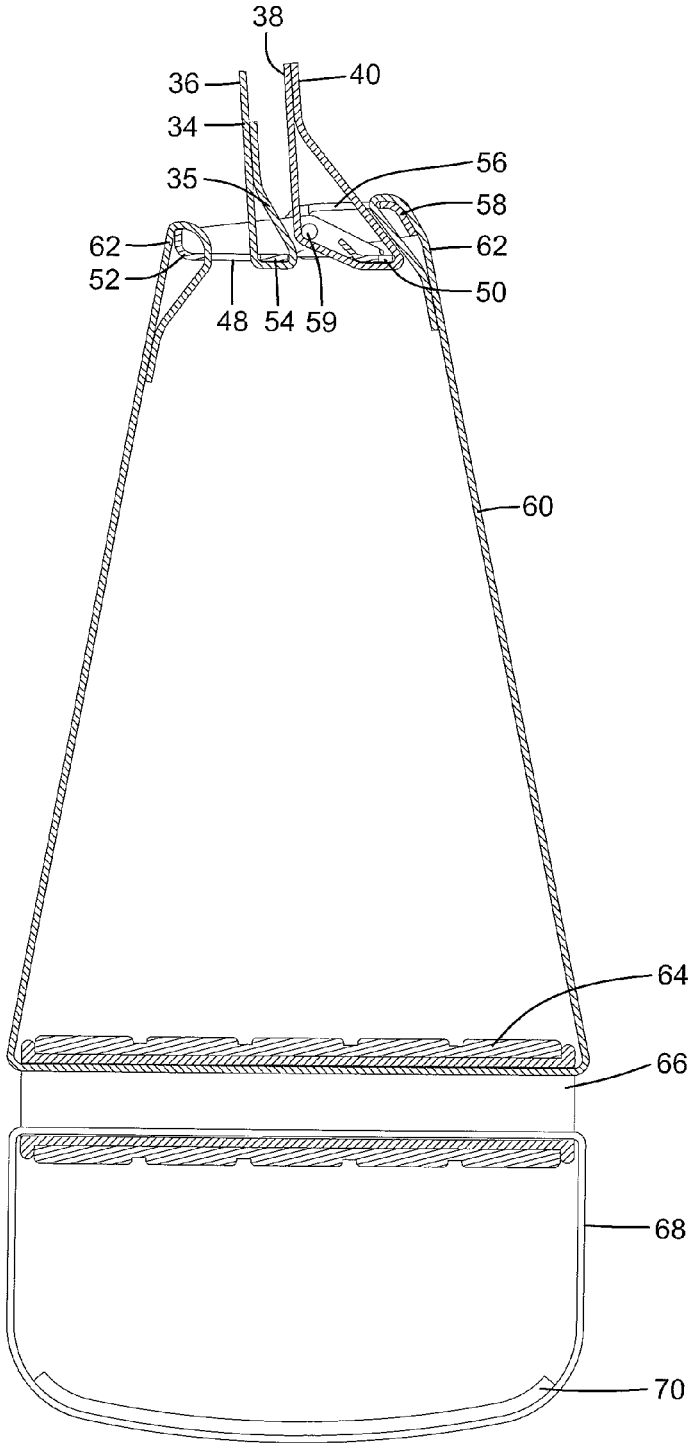
FIG. 3 shows an enlarged, cross sectional view of a handle and an adjusting member of the exerciser of FIG. 1.

According to the preferred form shown, exerciser 10 further includes two length-adjustable straps 34 made of inelastic fabric of canvas or nylon. Each strap 34 includes spaced first and second ends 35 and 37. Each strap 34 further includes first, second, and third sections 36, 38, and 40 between first and second ends 35 and 37. Second section 38 is intermediate first and third sections 36 and 40. First end 35 is located on an end portion of first section 36. Second end 37 is located on an end portion of third section 40. First section 36 of each strap 34 is wound around connecting ring 32 and faces a side of second section 38 of strap 34 (FIG. 2), and third section 40 of strap 34 is folded onto the other side of second section 38. Namely, each strap 34 is folded into three sections (FIG. 1). Second end 37 of each strap 34 faces of the connecting ring 32. First end 35 of each strap 34 has a spacing to connecting ring 32 larger than second end 37 of strap 34. A bend between second and third sections 38 and 40 of each strap 34 is approximately at the same level as first end 35 (FIG. 3).

Figure 4:
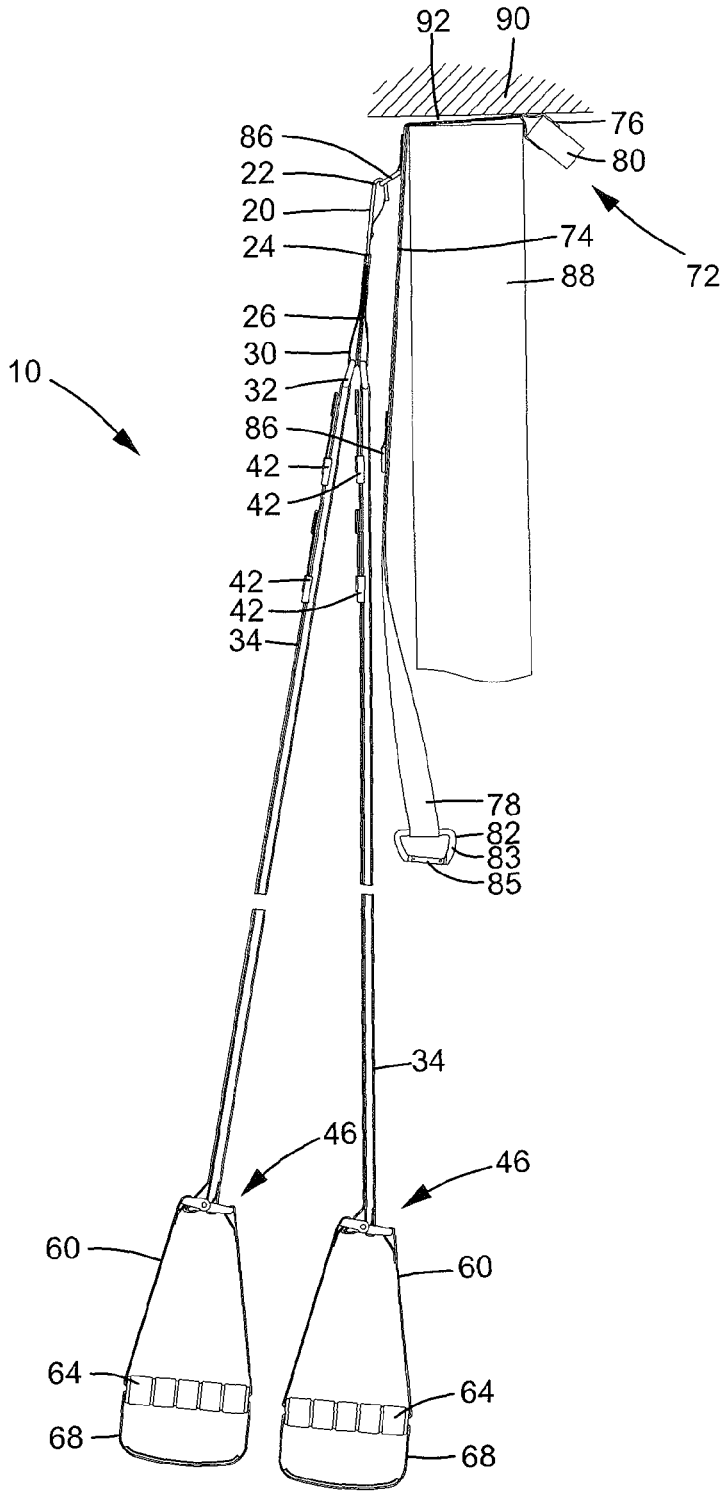
FIG. 4 shows a schematic view illustrating use of the exerciser of FIG. 1 on a door.
Figure 5:
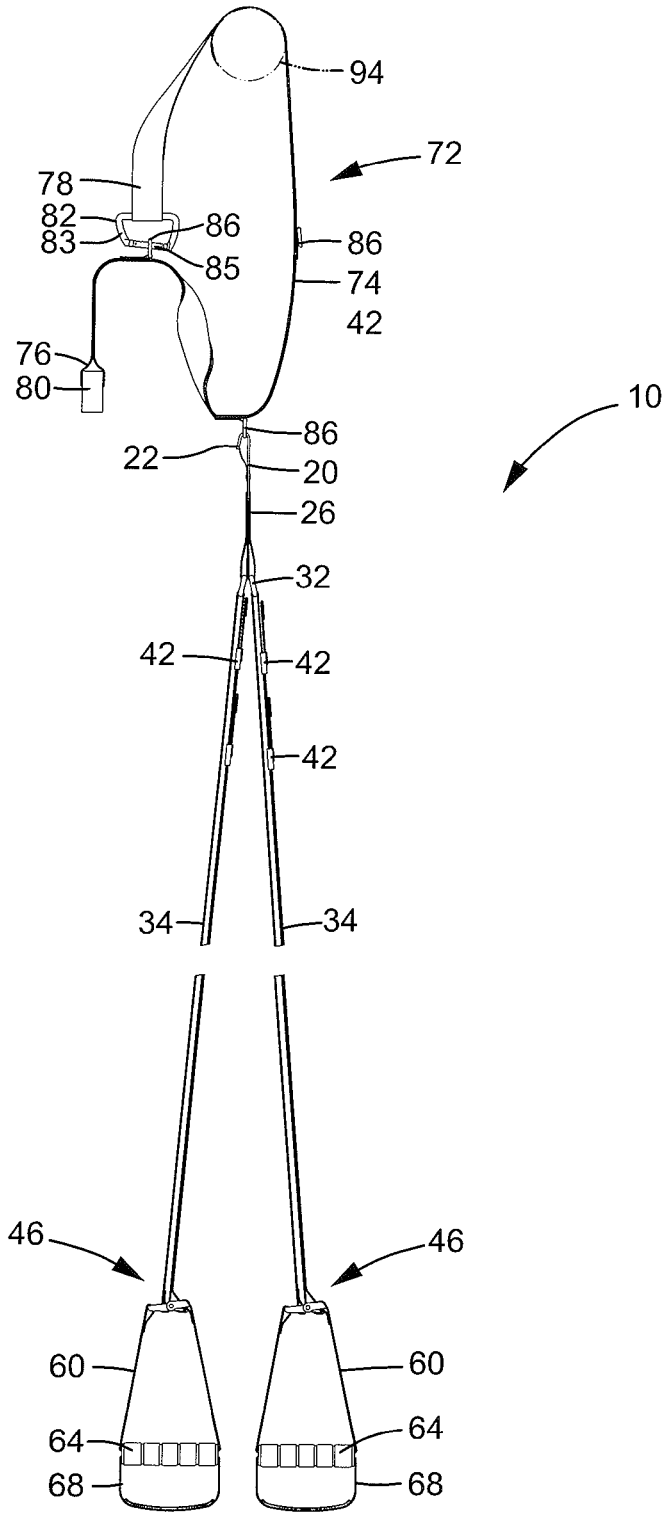
FIG. 5 shows a schematic view of the exerciser of FIG. 1 assembled for use around a rod-like object.

According to the preferred form shown, exerciser 10 further includes four sleeves 42 made of inelastic fabric of canvas or nylon. Two of sleeves 42 are mounted around second and third sections 48 and 40 of each strap 34 and sewn to third section 40 (FIGS. 2 and 4). FIGS. 1A and 2 show that upper sleeve 42 on each strap 34 is flush with end face of second end 37. Thus, each sleeve 42 can be moved to urge third section 40 to move along second section 38 of strap 34, increasing or shortening a spacing from connecting ring 32 to first end 35 (or to a bend between second and third sections 38 and 40). A pull tape 44 can be sewn to each sleeve 42 to allow manual pulling for moving sleeve 42 and third section 40 of one of straps 34. It can be appreciated that each strap 34 can include only one sleeve 42 to achieve the length-adjusting function.

Figure 3A:
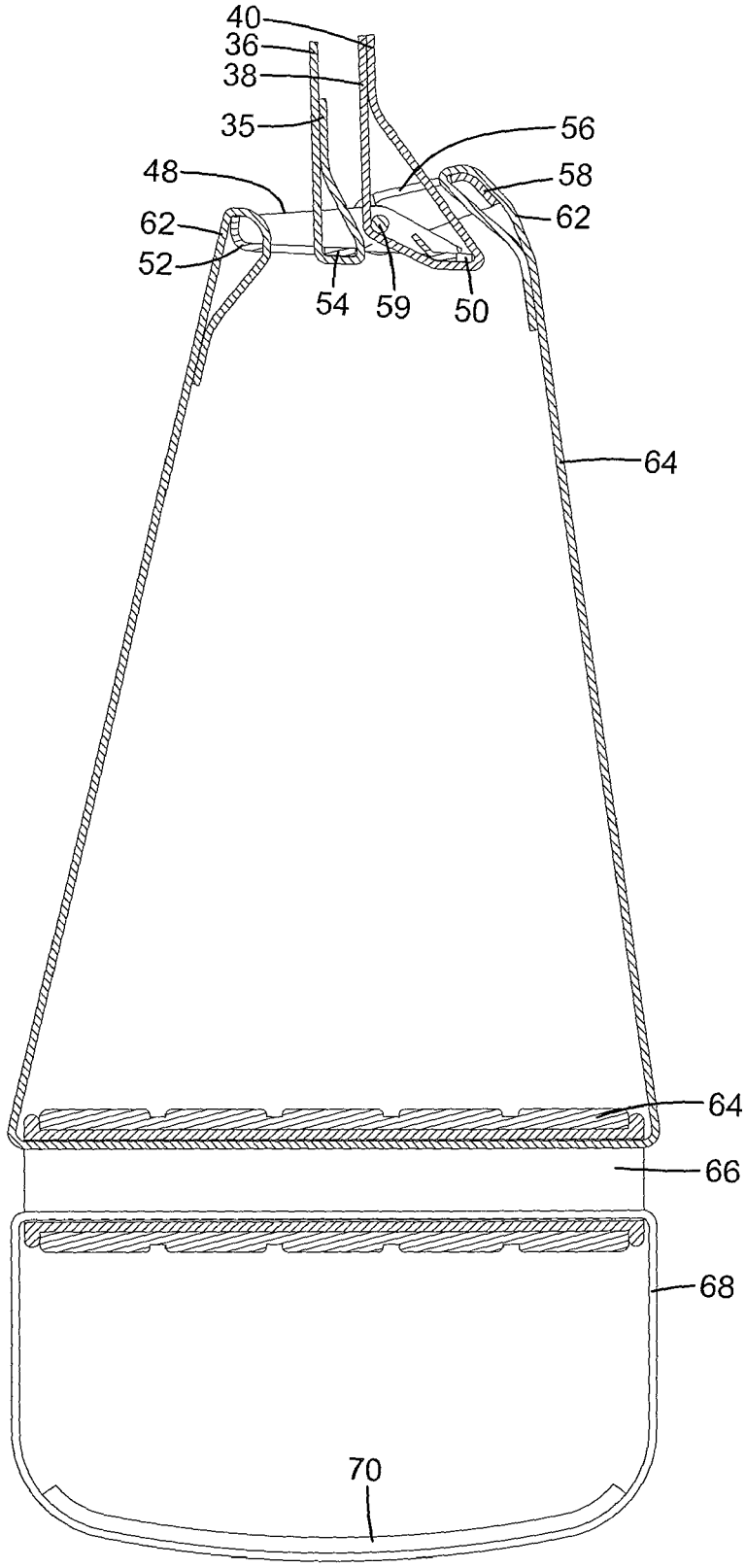
FIG. 3A is a view similar to FIG. 3, wherein an element of the adjusting member is pivoted to a disengagement position.

According to the preferred form shown, exerciser 10 further includes two adjusting members 46 each having first and second elements 48 and 56 and a pin 59 pivotably connecting first and second elements 48 and 56. First element 48 of each adjusting member 46 includes a toothed portion 50 and an edge 52 spaced from toothed portion 50. Each adjusting member 46 further includes a transverse bar 54 between the toothed portion 50 and edge 52. Second element 56 of each adjusting member 46 has an outer side 58. Second element 56 covers an outer side of first element 48. Toothed portion 50 of first element 48 is located adjacent outer side 58 of second element 56. Second element 56 is pivotable about a pivot axis defined by pin 58 between a stop position adjacent toothed portion 50 (FIG. 3) and a disengagement position away from toothed portion 50 (FIG. 3A). First end 35 of each strap 34 is wound around transverse bar 54 of one of adjusting members 46 and sewn to first section 36 of strap 34. The bend between second and third sections 38 and 40 of each strap 34 is wound around pin 59 and toothed portion 50 of one of adjusting member 46. Thus, each adjusting member 46 is engaged with one of straps 34 in a suspended manner.

According to the preferred form shown, exerciser 10 further includes two connecting straps 60 made of inelastic fabric of canvas or nylon. Each connecting strap 60 includes two ends 62 respectively connected to edge 52 and outer side 58 of one of adjusting members 46, so that each connecting strap 60 is hung around one of adjusting members 46. Each connecting strap 60 is extended through a through-hole 66 of a handle 64.

According to the preferred form shown, exerciser 10 further includes two suspension belts 68 made of inelastic fabric of canvas or nylon. A pad 70 formed of foam material is sewn to a face of each suspension belt 68. Each suspension belt 68 is extended through through-hole 66 of one of handles 64, so that pad 70 of suspension belt 6 is opposite to connecting strap 60.

According to the preferred form shown, exerciser 10 further includes a suspension member 72. Suspension member 72 includes a strap 74 made of inelastic fabric of canvas or nylon. Strap 74 includes first and second ends 76 and 78. In the most preferred form shown, a stop 80 is mounted to first end 76 of strap 74 and has cross sections larger than strap 74. A retaining ring 82 is mounted to second end 78 of strap 74. Retaining ring 82 includes a substantially C-shaped body 83 and a rod 85 pivotably connected to an end of body 83 and movable between an open position (see solid lines in FIG. 1) revealing an opening of body 83 and a closed position (see phantom lines in FIG. 1) closing the opening of body 83. Three fixing members 84 made of inelastic fabric of canvas or nylon are fixed to a side 79 of strap 74 of suspension member 72 after folding in two, providing a space between two folded portions of fixing member 84. A ring 86 is mounted to each fixing member 84 and extended through the space of fixing member 84.

Straps 34 can be adjusted to desired lengths according to the user needs or according to the place of use. Firstly, second element 56 of adjusting member 46 is pivoted to the disengagement position, so that sleeve 42 and third section 40 of strap 34 can be moved by pulling pull strap 44, adjusting the spacing between second end 37 and connecting ring 32. When second end 37 is moved away from connecting ring 32, the length of third section 40 of strap 34 is decreased, such that the overall length of first and second sections 36 and 38 of strap 34 is increased. Handle 64 is, thus, moved away from connecting ring 32. On the other hand, when second end 37 is moved towards connecting ring 32, the overall length of first and second sections 36 and 38 of strap 34 is decreased, and handle 64 is moved towards connecting ring 32.

Now that the basic construction of exerciser 10 of the preferred teachings of the present invention has been explained, the operation and some of the advantages of exerciser 10 can be set forth and appreciated. FIG. 4 shows use of exerciser 10 between two objects. Specifically, strap 74 of suspension member 72 is extended through a gap 92 between a first object 88 (such as a door) and a second object 90 (such as a door frame). Stop 80 is firmly stuck between first and second objects 88 and 90. Disengagement will not occur when strap 74 is subjected to force pulling strap 74 away from stop 80, because stop 80 has a size much larger than gap 92. First portion 22 of connecting member 20 can be engaged with any one of rings 86. This is the first mode of exerciser 10 allowing use in a place without any rod-like supporting structure.

Furthermore, suspension member 72 can be assembled to be in the form of a loop. This is the second mode of exerciser 10 allowing use of exerciser 10 around a rod-like object 94 such as a rail or a trunk of a tree. Specifically, strap 74 is wound around object 94, and retaining ring 82 is then engaged with one of rings 86. First portion 22 of connecting member 20 is engaged with another ring 86.

When handles 64 or suspension belts 68 are pulled, second elements 56 pivot to the stop position, so that each strap 34 is sandwiched and frictionally retained between toothed portion 50 of one of first elements 48 and outer side 58 of one of second elements 56.

Figure 7:
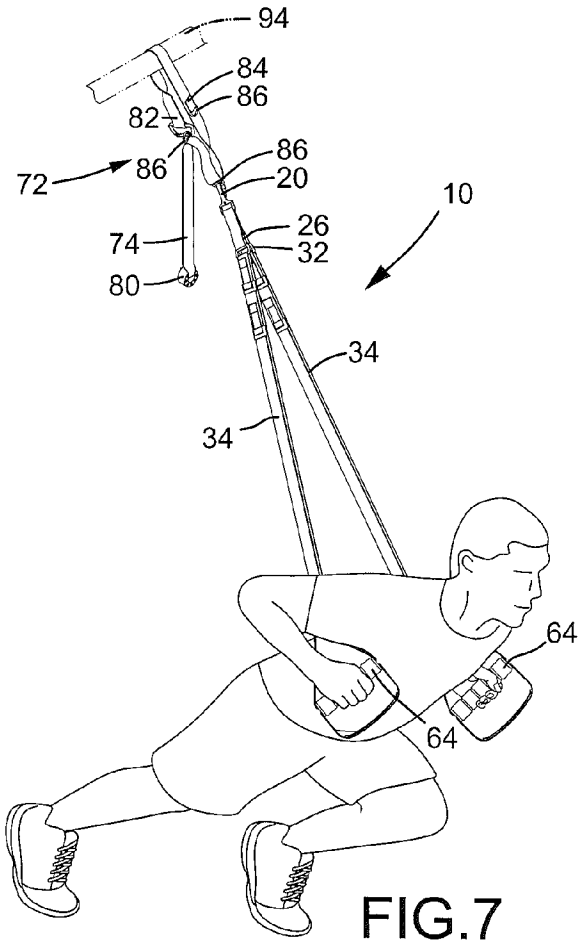
FIGS. 6-11 illustrate poses of a user using the exerciser according to the present invention.
Figure 6:
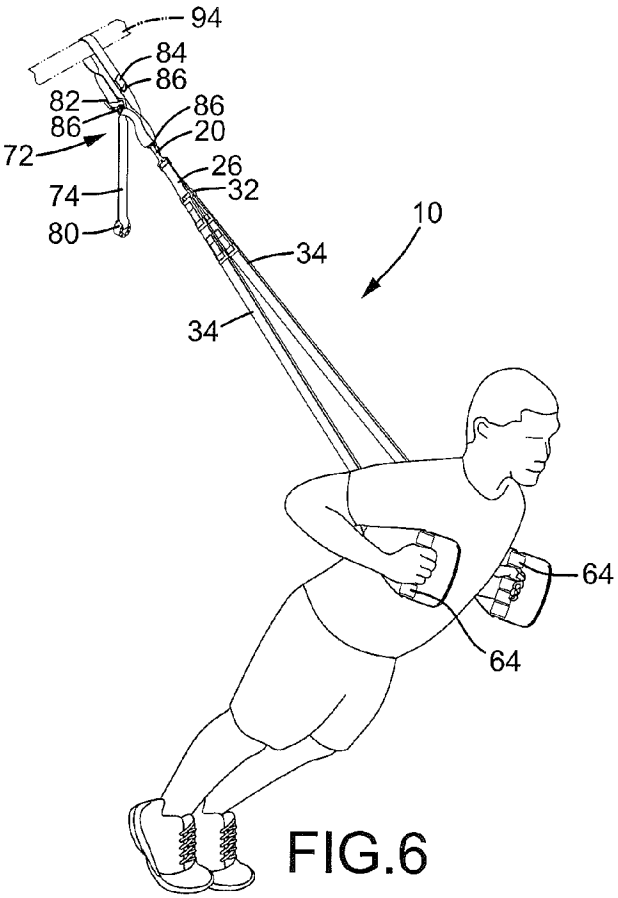

FIGS. 6-11 show examples of use of exerciser 10 in the second mode. With reference to FIG. 6, the user can grip handles 64 with both hands and lean forward with the upper arms at an angle to the forearms and with the wrists close to the sides of the body. The weight of the user is transmitted by exerciser 10 to object 94, maintaining the user in the inclined position. Then, the user can step forward with one of the legs bent in about 90°, as shown in FIG. 7. The user then moves back to the pose shown in FIG. 6 and steps forward with the other leg. The movement can be repeated to exercise the muscles of the arms and the legs.

Figure 9:
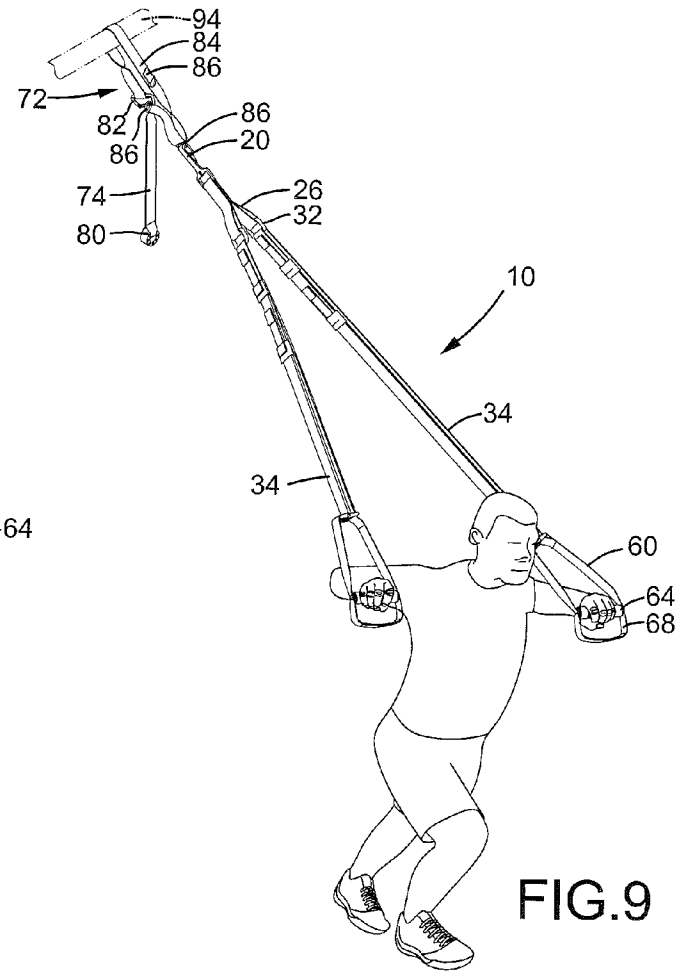
Figure 8:
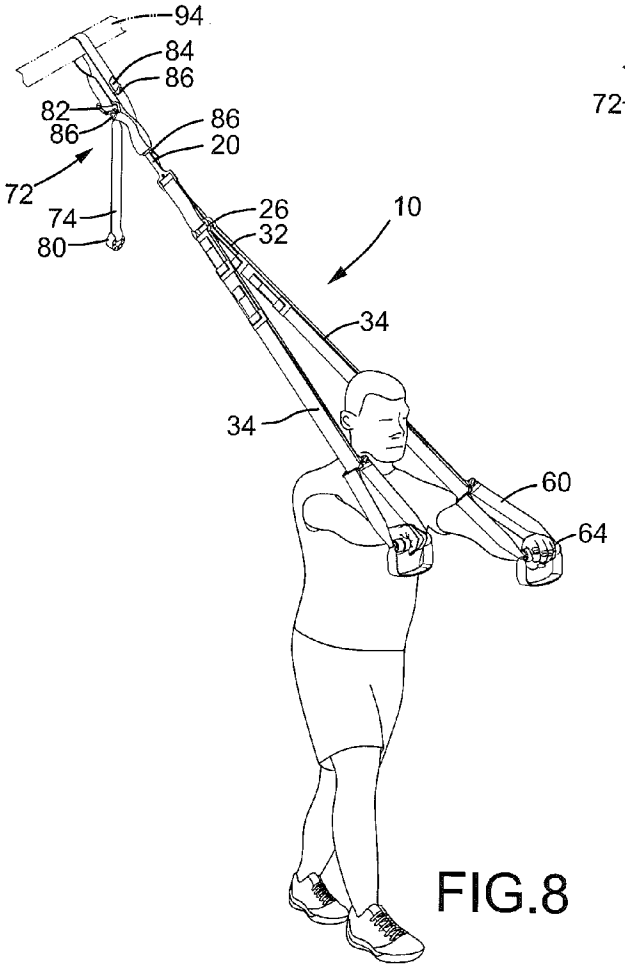

In another example, the user can grip handles 64 with both handles and slightly split the legs in a forward/rearward direction and reach out the arms, as shown in FIG. 8. Then, one of the legs is bent, and the other leg is straight, as shown in FIG. 9. The user then moves back to the pose shown in FIG. 8. The movement can be repeated to exercise the muscles of the upper arms and the forearms.

Figure 11:
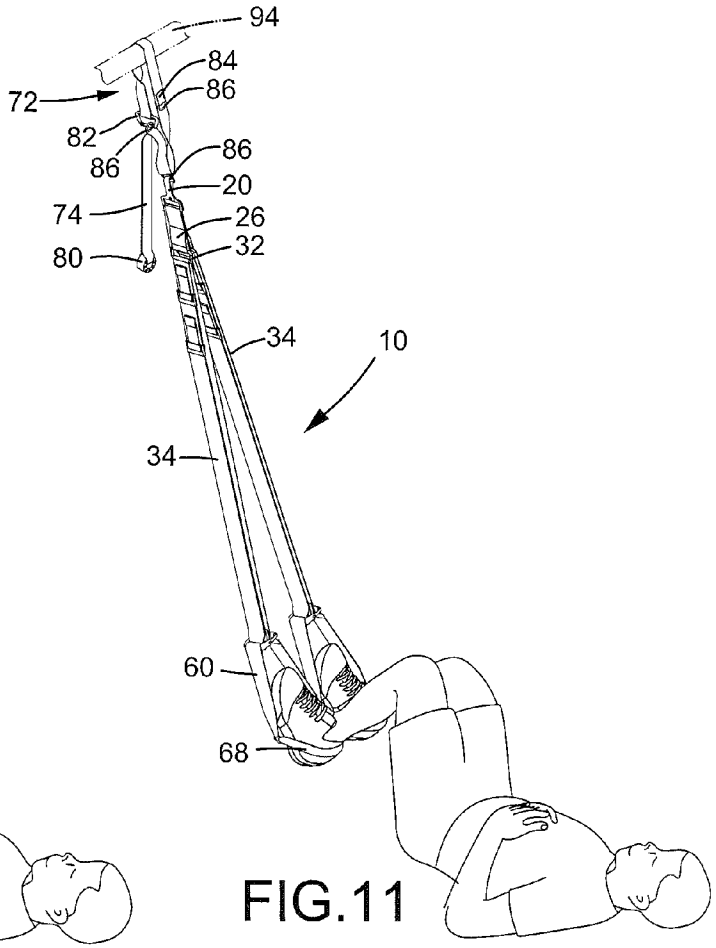
Figure 10:
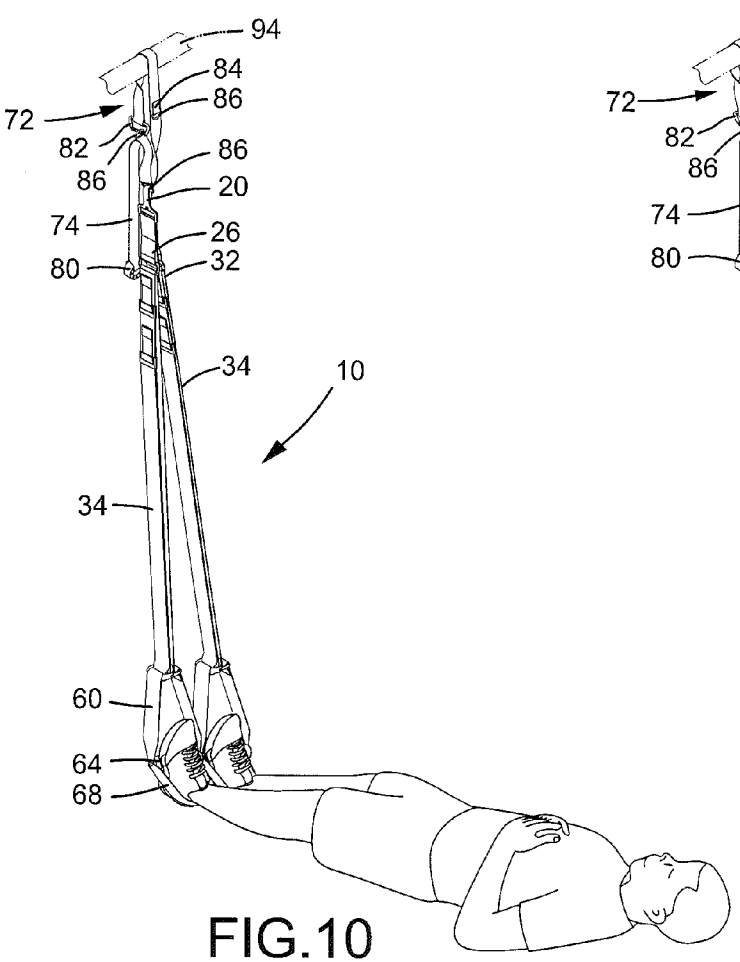

In a further example, the user can lie down on the back and hook handles 64 by the feet with the heels resting on pads 70. The legs are straight, and the arms are around the chest, as shown in FIG. 10. Then, the legs are moved toward the arms until the thighs are at about 90° to the shanks. The buttocks and a portion of the back of the user are moved away from the ground, as shown in FIG. 11. The user then moves back to the pose shown in FIG. 10. The movement can be repeated to exercise the muscles of the abdomen.

Suspension member 72 of exerciser is detachable when not in use. Thus, exerciser 10 according to the present invention can be used in different places to perform different exercises resisting the weight of the user, exercising different muscles of the body. Exerciser 10 according to the present invention is light and small, allowing easy storage and carriage.

Now that the basic teachings of the present invention have been explained, many extensions and variations will be obvious to one having ordinary skill in the art. For example, strap 74 of suspension member 72 does not have to include fixing members 84. Instead, strap 74 can include a plurality of engaging holes for attaching rings 86. Furthermore, the intersection between second and third sections 38 and 40 of each strap 34 does not have to be wound around toothed portion 50 and pin 59. Instead, the intersection between second and third sections 38 and 40 can only be wound around toothed portion 50. In this case, the length of each strap 34 can not be adjusted when second element 56 is in the stop position. When second element 56 is in the disengagement position, the length of each strap 34 can be adjusted by pulling pull tape 44 to move second end 37.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. An exerciser comprising, in combination:

a connecting member (20) including first and second portions (22, 24);

a linking member (26) including a first linking portion (28) and two second linking portions (30), with the first linking portion (28) engaged with the second portion (24) of the connecting member (20);

two connecting rings (32) engaged with the two second linking portions (30);

two straps (34) each having first and second ends (35, 37), with each of the two straps (34) including first, second, and third sections (36, 38, 40) between the first and second ends (35, 37), with the second section (38) located intermediate the first and third sections (36, 40), with the first end (35) located on an end portion of the first section (36), with the second end (37) located on an end portion of the third section (40), with the first and second sections (36, 48) of each of the two straps (34) hung on one of the two connecting rings (32) with the first section (36) facing a side of the second section (38), with the third section (40) folded onto another side of the second section (38), with the first end (35) of each of the two straps (34) having a spacing to the two connecting rings (32) larger than the second end (37) of the strap (34);

two sleeves (42) each wound around the second and third sections (38, 40) of one of the two straps (34), with each of the two sleeves (42) fixed to the third section (40) of one of the two straps (34), with each of the two sleeves (42) movable along the second section (38) of one of the two straps (34) to move the third section (40) of the strap (34);

two first elements (48) each including a toothed portion (50) and an edge (52) spaced from the toothed portion (50), with each of the two first elements (48) further including a transverse rod (54) between the toothed portion (50) and the edge (52), with the first end (35) of each of the two straps (34) connected to the transverse rod (54) of one of the two first elements (48), with the second and third sections (38, 40) of each of the two straps (34) wound around the toothed portion (50) of one of the two first elements (48);

two second elements (56) respectively and pivotably connected to the two first elements (48), with each of the two second elements (56) including an outer side (58), with each of the two second elements (56) pivotable between a stop position adjacent the toothed portion (50) and a disengagement position distant to the toothed portion (50);

two connecting straps (60) each including two ends (62), with the two ends (62) of each of the two connecting straps (60) connected to the edge (52) of one of the two first elements (52) and the outer side (58) of one of the two second elements (58);

two handles (64) each mounted to one of the two connecting straps (60);

two suspension belts (68) each mounted to one of the two handles (64);

an inelastic strap (74) including first and second ends (76, 78);

a stop (80) engaged with the first end (76) of the inelastic strap (74) and having cross sections larger than the inelastic strap (74);

a plurality of rings (86) fixed to the inelastic strap (74); and a retaining ring (82) engaged with the second end (78) of the inelastic strap (74);

wherein when either of the two second elements (56) is in the disengagement position, a first spacing between the third section (40) of one of the two straps (34) engaged with the second element (56) and one of the two connecting rings (32) is adjustable by moving one of the two sleeves (42) mounted on the strap (34), a second spacing between one of the two handles (64) associated with the second element (56) to one of the two connecting rings (32) increases when the first spacing decreases, wherein when the two handles (64) or the two suspension belts (68) are pulled, the two second elements (56) pivot to the stop position, so that each of the two straps (34) is sandwiched and frictionally retained between the toothed portion (50) of one of the two first element (48) and the outer side (58) of one of the two second elements (56), wherein the first portion (22) of the connecting member (20) is releasably engageable with one of the plurality of rings (86), and the retaining member (82) is releasably engageable with one of the plurality of rings (86), so that the inelastic strap (74) forms a loop.

2. The exerciser as claimed in claim 1, further comprising, in combination: a plurality of fixing members (84), with each of the plurality of fixing members (84) folded in two and fixed to a side (79) of the inelastic strap (74) with a space formed between two folded portions of each of the plurality of fixing members (84), with each of the plurality of rings (86) engaged with one of the plurality of fixing members (84) and extended through the space of the fixing member (84).

* * * * *